US005113750A

United States Patent [19]

Sherman

[11] Patent Number: 5,113,750

[45] Date of Patent: May 19, 1992

[54] AIR AND LIQUID EVACUATION APPARATUS

[76] Inventor: Larry W. Sherman, Rte. 1, Box 261-A, Lettsworth, La. 70753

[21] Appl. No.: 657,405

[22] Filed: Feb. 19, 1991

[51] Int. Cl.[5] ..... B08B 15/00

[52] U.S. Cl. ..... 454/63; 24/303

[58] Field of Search ..... 98/42.05, 115.1, 115.4; 24/3 R, 303, 306; 248/206.5

[56] References Cited

U.S. PATENT DOCUMENTS

| | | | |
|---|---|---|---|
| 2,361,861 | 10/1944 | Masowich | 98/115.4 X |
| 3,380,371 | 4/1968 | Scheel | 98/115.4 |
| 3,492,937 | 2/1970 | Ambli | 98/115.4 X |
| 4,617,033 | 10/1986 | Strang | 98/115.4 X |

FOREIGN PATENT DOCUMENTS

| | | | |
|---|---|---|---|
| 134433 | 6/1987 | Japan | 98/115.4 |
| 705949 | 3/1954 | United Kingdom | 98/42.05 |

*Primary Examiner*—Harold Joyce
*Attorney, Agent, or Firm*—Leon Gilden

[57] ABSTRACT

An elongate flexible conduit is in pneumatic communication with a rigid conduit, wherein the rigid conduit is defined by a reduced diameter relative to the flexible conduit, and wherein an air delivery tube is directed interiorly of the rigid conduit with a leg thereof coaxially aligned with the rigid conduit to effect negative pressure within the flexible conduit for evacuation of gaseous fumes of liquid.

1 Claim, 4 Drawing Sheets

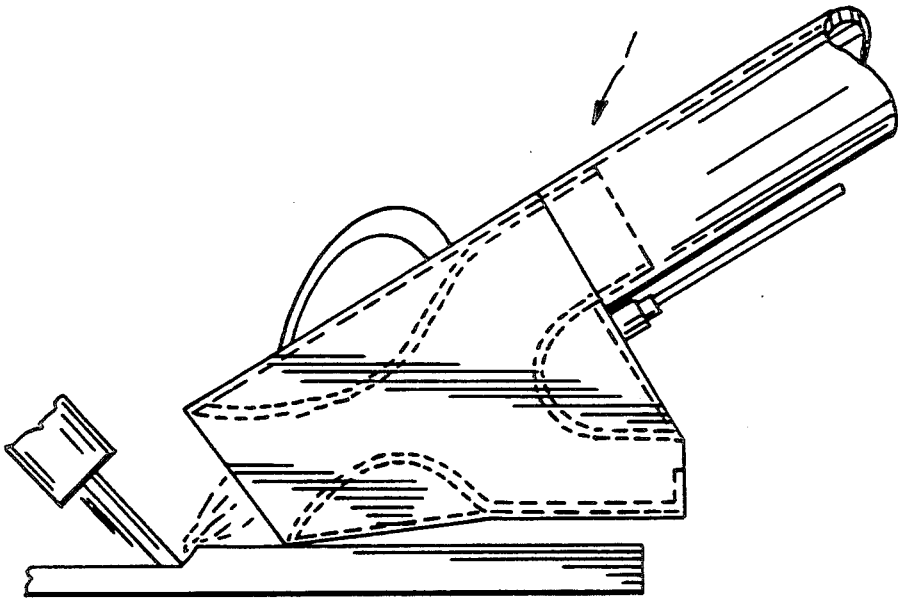
Fig 1
PRIOR ART
Fig 2
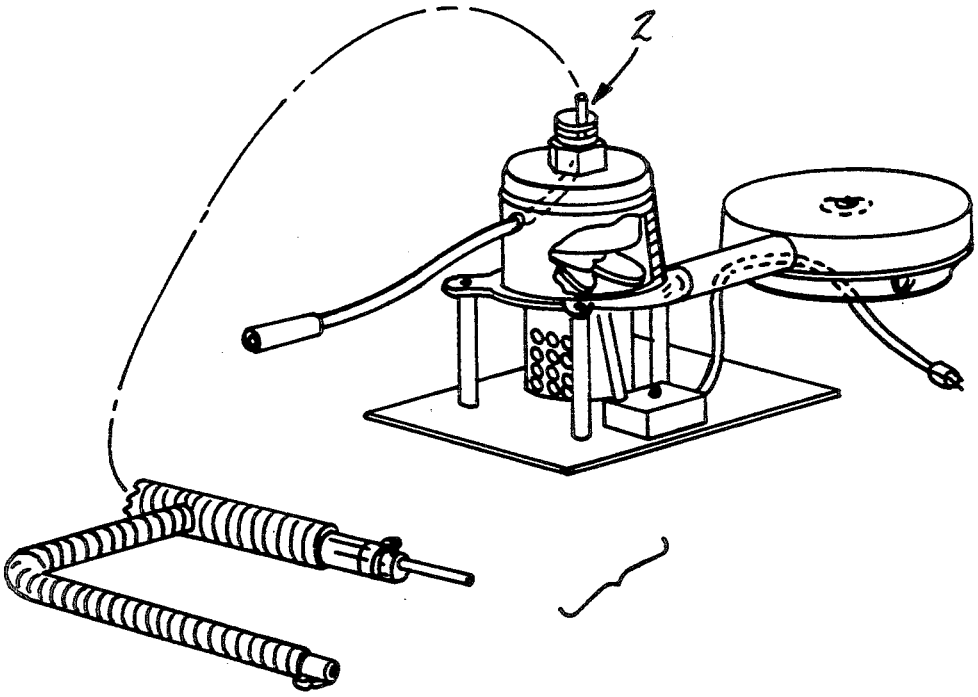
PRIOR ART

AIR AND LIQUID EVACUATION APPARATUS

BACKGROUND OF THE INVENTION

1. Field of the Invention

The field of invention relates to evacuation apparatus, and more particularly pertains to a new and improved air and liquid evacuation apparatus wherein the same directs welding fumes relative to a welding site to a location remote from the welding site.

2. Description of the Prior Art

Fumes resulting from molten metal and slag as resulted from various welding procedures such as carbon-arc and the like is desirable to provide for an environmentally safe working environment for individuals. Prior art apparatus which has addressed this problem may be found for example in U.S. Pat. No. 4,493,970 to Rieppel, et al. utilizing a refrigerated surface utilized to intercept and cool molten particles to provide adherence of the article relative to an exhaust tube of the organization.

U.S. Pat. No. 4,617,033 to Strang sets forth an arc welding filter wherein a blower is adapted to draw gases away from a welding operation.

U.S. Pat. No. 4,347,427 to Gentilo, et al. sets forth a structure utilizing a submerged arc welding gun.

U.S. Pat. No. 4,358,662 to Cranor, et al. sets forth a fume exhausting attachment for use in soldering guns, wherein a surrounding skirt relative to a soldering tip is in communication with a pnematically related suction tube.

Similarly, U.S. Pat. No. 4,493,823 to Mann sets forth a multiple passage conduit in surrounding relationship relative to a welding gun and is arranged for directing and conveying gas relative to a welding site.

As such, it may be appreciated that there continues to be a need for a new improved air and liquid evacuation apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of welding fume evacuation apparatus now present in the prior art, the present invention provides an air and liquid evacuation apparatus wherein the same sets forth an organization easily manipulated relative to a welding site for withdrawing fumes and transporting such fumes to relatively extended distances. As such, the general purpose of the present invention, which will be described subsequently in greater detail, is to provide a new and improved air and liquid evacuation apparatus which has all the advantage of the prior art welding fume evacuation apparatus and none of the disadvantages.

To attain this, the present invention provides an elongate flexible conduit in pneumatic communication with a rigid conduit, wherein the rigid conduit is defined by a reduced diameter relative to the flexible conduit, and wherein an air delivery tube is directed interiorly of the conduit to effect negative pressure within the flexible conduit to evacuation of gaseous fumes or liquid.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air and liquid evacuation apparatus which has all the advantages of the prior art welding fume evacuation apparatus and none of the disadvantages.

It is another object of the present invention to provide a new and improved air and liquid evacuation apparatus which may be easily and efficiently manufactured and marketed.

It is a further object of the present invention to provide a new and improved air and liquid evacuation apparatus which is of a durable and reliable construction.

An even further object of the present invention is to provide a new and improved air and liquid evacuation apparatus which is susceptible of a low cost of manufacture with regard to both materials and labor, and which accordingly is then susceptible of low prices of sale to the consuming public, thereby making such air and liquid evacuation apparatus economically available to the buying public.

Still yet another object of the present invention is to provide a new and improved air and liquid evacuation apparatus which provides in the apparatuses and methods of the prior art some of the advantages thereof, while simultaneously overcoming some of the disadvantages normally associated therewith.

Still another object of the present invention is to provide a new and improved air and liquid evacuation apparatus wherein the same is readily manipulated and positioned relative to a welding site for extracting fumes and the like therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view, taken in elevation, of a prior art welding fume evacuation apparatus.

FIG. 2 is an isometric illustration of a further example of a prior art fume evacuation apparatus utilizing a filter.

FIG. 7 is an isometric illustration of the instant invention utilizing a quick coupling for the pressurized pneumatic tube relative to the rigid conduit.

DESCRIPTION OF THE PREFERRED EMBODIMENT

Figure 3:
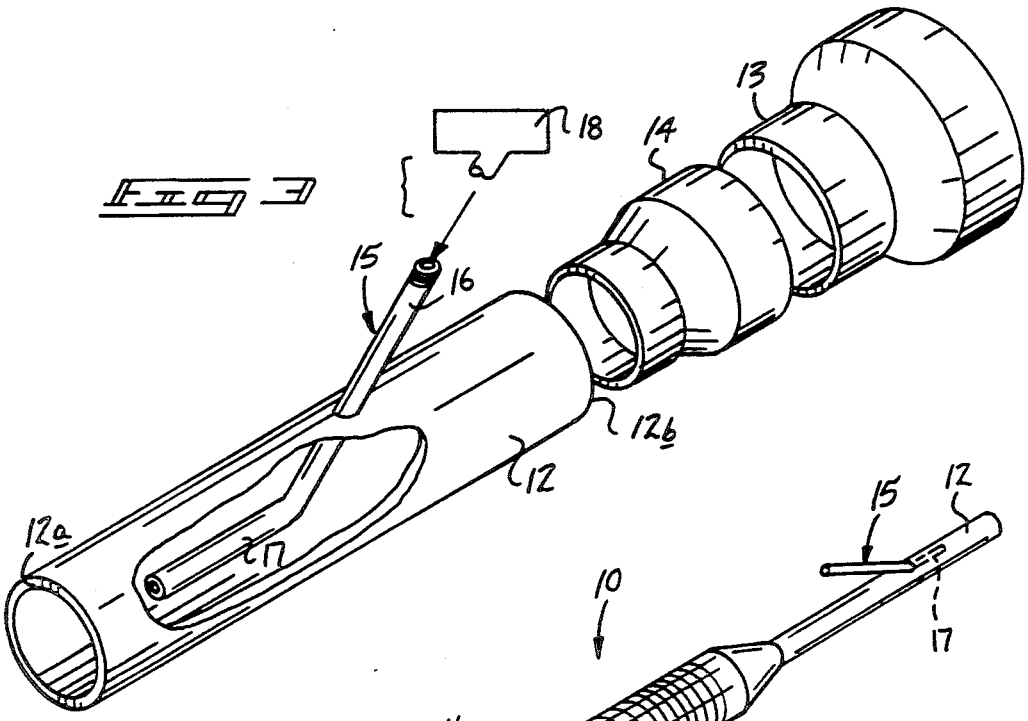
FIG. 3 is an isometric illustration of the rigid conduit structure utilized by the instant invention.
Figure 4:
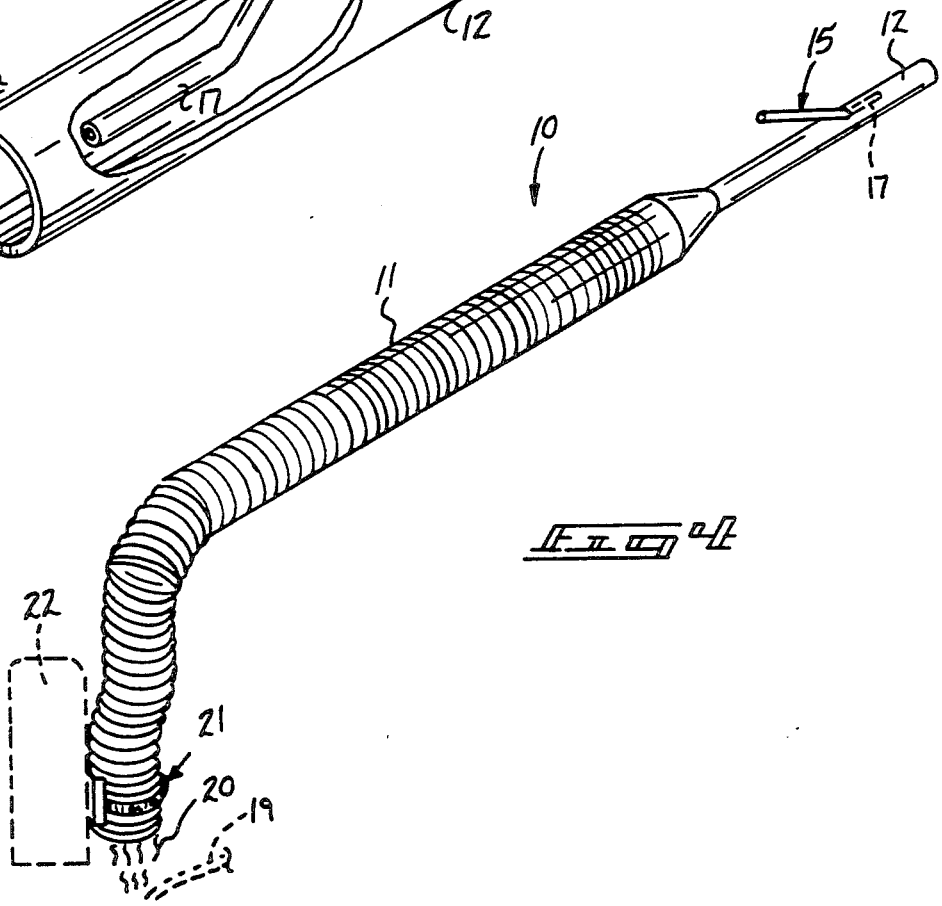
FIG. 4 is an isometric illustration of the instant invention relative to a welding site.
Figure 5:
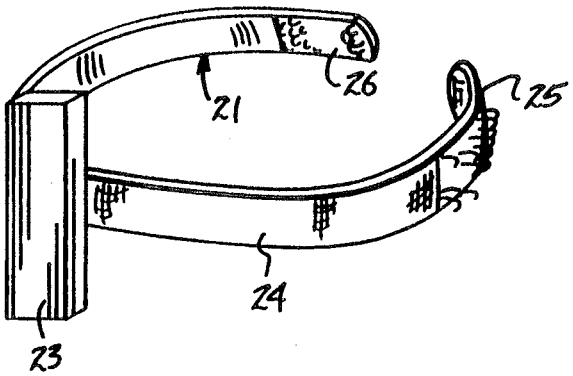
FIG. 5 is an isometric illustration of the mounting band utilized by the instant invention.
Figure 6:
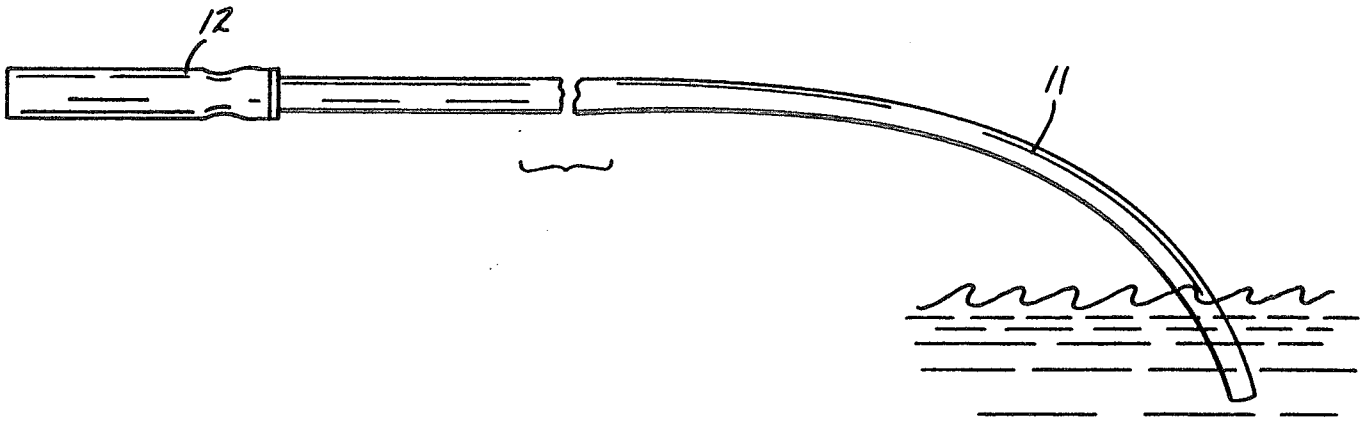
FIG. 6 is an orthographic side view of the instant invention positioned for extraction of liquid.
Figure 11:
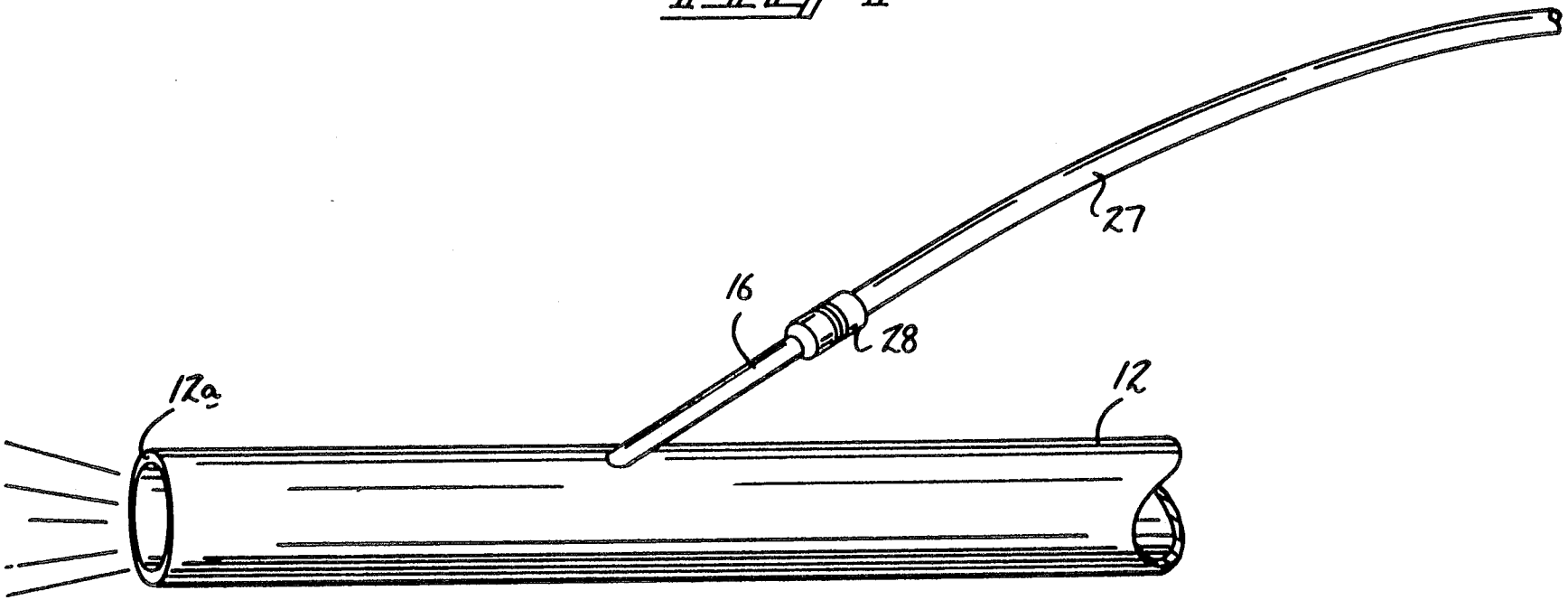

With reference now to the drawings, and in particular to FIGS. 1 to 7 thereof, a new and improved air and liquid evacuation apparatus embodying the principles and concepts of the present invention and generally designated by the reference numeral 10 will be described.

FIG. 1 illustrates a prior art evacuation apparatus, as exemplified and presented in U.S. Pat. No. 4,493,970, utilizing a refrigerant surface for minimizing collection of molten metal adherence to the collector, with the collector utilizing an evacuation tube.

FIG. 2, as set forth in U.S Pat. No. 4,617,033, sets forth an evacuation apparatus utilizing a filtration system relative to a welding site.

More specifically, the air and liquid evacuation apparatus 10 of the instant invention essentially comprises an elongate pleated flexible conduit 11 formed as a series of parallel cylindrical pleats, wherein the first flexible conduit is defined by a first diameter. A rigid conduit 12 is provided defined by a third diameter less than the first diameter. The rigid conduit 12 includes an outlet end 12*a* and an inlet end 12*b*. A first reducer pipe 13 defining an inlet of the first diameter and an outlet of a second diameter is mounted to a second reducer pipe 14, including an inlet of a second diameter and an outlet of a third diameter to permit mounting of the rigid conduit to the flexible conduit. The use of the reducer pipes further permits selective mounting of flexible conduits of a first diameter, as well as a second diameter, to provide for a greater negative pressure if required, such as in the evacuation of fluid. A pressurized air delivery tube 15 is fixedly and integrally mounted to the rigid conduit 12 and includes a first leg directed diametrically into the rigid conduit from a position exteriorly thereof to define an oblique angle between the first leg 15 and the axis of the conduit 12. A second leg of the delivery tube 15 is coaxially aligned with the axis of the rigid conduit and is spaced from and projects towards the outlet end 12*a* thereof to provide negative pressure between the second leg and an entrance of the flexible conduit 11 to direct fumes and fluid therein, as required. As exemplified in FIG. 4 for example, a mounting band 21 (see FIG. 5) utilizes a ferro magnet 23 mounted medially of the strap member 24. The strap member 24 includes respective first and second hook and loop strap ends 25 and 26 for permitting surrounding securement of the band 21 adjacent the entrance end portion of the flexible conduit to permit use of the ferro magnet and securing of the ferro magnet to a ferro metallic support 22 relative to a welding torch at a welding site to direct fumes 20 into the entrance of the flexible conduit. Further, the strap member 24 defines a circumference greater than that of the entrance end of the flexible conduit to permit the flexible band to extend about the flexible conduit, as well as to a support object that the flexible conduit is to be secured to. In use, a quick coupler connection 27 mounts the rigid air delivery tube's first leg 16 to a pneumatic hose 27 and in turn is associated with a pressurized air delivery source 18 (see FIG. 3) such as an air compressor and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air and liquid evacuation apparatus comprising, in combination, an elongate pleated flexible conduit, the pleated flexible conduit defined by a series of parallel cylindrical pleats defining a first diameter, and the pleated flexible conduit in pneumatic communication with a rigid conduit, wherein the rigid conduit includes an inlet end and an outlet end, with the pleated flexible conduit mounted to the inlet end, and the rigid conduit defined by a third diameter less than the first diameter, and reducer means for effecting sealed communication of the pleated flexible conduit to the inlet end of the rigid conduit, and a pressurized air delivery tube fixedly mounted to and projecting interiorly of the rigid conduit, and pressurized air directed into the pressurized air delivery tube to effect a negative pressure within the pleated flexible conduit, and wherein the reducer means includes a first reducer pipe defined by an inlet of the first diameter and an outlet of the second diameter, with the inlet mounted to a rear end portion of the pleated flexible conduit, and the outlet of the first reducer pipe mounted to a further inlet of the second diameter, and the second reducer pipe including a further outlet defined by the third diameter for securement of the inlet and the rigid conduit to the further outlet, and wherein the pressurized air delivery tube includes a first leg diametrically and fixedly directed into the rigid conduit defining an oblique angle between the first leg and an axis defined by the rigid conduit, and the pressurized air delivery tube further including a second leg positioned within the rigid conduit coaxially aligned with the rigid conduit projecting towards the outlet end of the rigid conduit and spaced from the outlet end, and a pressurized air delivery source in operative communication with the first leg to direct pressurized air through the first leg, and including a flexible delivery conduit in operative communication between the pressurized air delivery source and the first leg, and including a quick coupling connection mounted to the flexible delivery conduit and the first leg for selective securement between the flexible delivery conduit and the first leg, and including a mounting band selectively securable about the pleated flexible conduit adjacent the free terminal end of the pleated flexible conduit remote from the rigid conduit, wherein the mounting band includes a flexible strap member, and the flexible strap member includes a first strap end including a first hook and loop fastener and a second strap end including a second hook and loop fastener, wherein the first and second strap ends fasteners are selectively securable relative to one another about the pleated flexible conduit, and the strap member further including a ferromagnet fixedly mounted about the strap member for securement to a ferrous metallic support.

* * * * *